US006871500B2

(12) United States Patent
Schwarz et al.

(10) Patent No.: US 6,871,500 B2
(45) Date of Patent: Mar. 29, 2005

(54) GAS OPERATED CONTRACTION DRIVE

(75) Inventors: Stefan Schwarz, Altdorf (DE); Bernd Lorenz, Baltmannsweiler (DE); Karl Birk, Eberbach (DE)

(73) Assignees: Festo AG & Co., Esslingen (DE); TRW Occupant Restraint Systems, Eberach (DE)

( * ) Notice: Subject to any disclaimer, the term of this patent is extended or adjusted under 35 U.S.C. 154(b) by 0 days.

(21) Appl. No.: 10/409,302

(22) Filed: Apr. 8, 2003

(65) Prior Publication Data

US 2003/0194264 A1 Oct. 16, 2003

(30) Foreign Application Priority Data

Apr. 12, 2002 (DE) ..... D 202 05 653 U

(51) Int. Cl.[7] ..... F01B 29/10
(52) U.S. Cl. ..... 60/638; 60/632
(58) Field of Search ..... 60/632, 633, 638

(56) References Cited

U.S. PATENT DOCUMENTS

| | | | | | |
|---|---|---|---|---|---|
| 4,619,111 | A | * | 10/1986 | Whiteman | 60/632 |
| 5,033,270 | A | | 7/1991 | Hardt | |
| 5,090,297 | A | * | 2/1992 | Paynter | 92/48 |
| 5,366,245 | A | * | 11/1994 | Lane, Jr. | 280/806 |
| 5,842,657 | A | * | 12/1998 | Modzelewski | 242/374 |

FOREIGN PATENT DOCUMENTS

| | | |
|---|---|---|
| EP | 0 161 750 | 12/1988 |
| WO | WO00/61952 | 10/2000 |

* cited by examiner

*Primary Examiner*—Hoang Nguyen
(74) *Attorney, Agent, or Firm*—Hoffmann & Baron, LLP

(57) ABSTRACT

A gas operated contraction drive with a contractible hose, which undergoes longitudinal contraction when a working space defined by it is subjected to a pressurizing drive gas. The contractible hose is fitted with at least one pyrotechnic gas generator.

14 Claims, 1 Drawing Sheet

GAS OPERATED CONTRACTION DRIVE

BACKGROUND OF THE INVENTION

The invention relates to a gas operated contraction drive comprising a contractible hose which under the action of pressure of a drive gas in a working space, delimited by the hose, is longitudinally contracted.

THE PRIOR ART

A contractible hose of this type is for example described in the patent publication WO 00/61952 A1 and the European patent publication 0161750 B1. In this case it comprises a hose body with rubber-elastic properties and a contractible hose made up of a tensile fiber arrangement arranged coaxially in relation to the hose body and attached at the end in a sealing manner to two force applying units. Each force applying part includes suitable force applying means, as for example in the form of threaded holes or attachment eyes, by way of which external application of force may take place. The working space delimited jointly by the contractible hose and the two force applying units may be subjected to the action of a drive gas through one of the force applying units in order to produce a radial expansion and an accompanying axial contraction of the contractible hose. Accordingly the force applying units are drawn together and make possible the application of a force. t is in this manner that any desired structures and components may be braced together or moved in relation to one another.

In the case of certain applications the activation times are too long with known contraction drives. This is normally owing to the insufficient cross section and/or the excessive length of the lines conducting the drive gas from the pressure source to the contraction drive.

SHORT SUMMARY OF THE INVENTION

One object of the present invention is to provide measures which permit an improved response behavior and a higher operating rate of the contraction drive.

In order to achieve these and/or other objects appearing from the present specification, claims and drawings, in the present invention the contraction drive for generating the drive gas is fitted with at least one pyrotechnic gas generator.

It is in this manner that the pressure medium source for the drive gas is directly associated with the contraction drive. Its design as a pyrotechnic gas generator entails small dimensions and accordingly an optimum integration or adaptation on the contraction drive. The ducts carrying the drive gas produced to the working space may be extremely short and designed with a large cross section, there even being the possibility of locating the gas generator directly in the working space of the contraction drive so that the production of the drive gas takes place directly at the position where the drive gas is required for generating pressure. Since there is no need to lay fluid pipes leading to the contraction drive, installation is moreover quite simple, even in the case of limited space or in the case of lack of accessibility of the spaces. If the pyrotechnic gas generator is designed for electrical ignition, only relatively simple wiring will be required or it is even possible to have a wireless transmission of the ignition signals.

Further advantageous developments of the invention are defined in the claims.

The contractible hose may with advantage comprise a hose body manufactured of a rubber-elastic material and a tensile fiber arrangement coaxial to the hose body, the latter preferably being embedded in the wall of the hose body.

It is an advantage for the contraction drive to possess a respective force applying unit arranged at the two end portions of the contractible hose to render possible the use of the drive force produced, the gas generator being secured in one of the force applying units. It is more particularly possible for at least one force applying unit to comprise a receiving recess open toward the interior space of the contractible hose, in which space the gas generator is placed. Given a suitable design of the receiving recess the latter may ensure a shielding of the contractible hose from the effects of firing of the gas generator so that damage to the contractible hose is prevented.

In the case of a particularly convenient design of the force applying unit a force applying part is provided fitted with externally accessible force applying means, having a plate-like anchoring section extending at the end into the contractible hose, a hump-like raised portion being provided on the two flat sides of the anchoring section, and this raised portion can be snugly engaged by the slipped-on contractible hose. At the hump-like raised portions a retaining cuff surrounding the contractible hose is placed, which internally is made concave corresponding to the hump-like raised portions so that the intermediately placed wall of the contractible hose is secured along a substantial length, more particularly by pressing.

If there is an additional provision for the force applying part and the retaining cuff to be able to be moved to limited extent in the draw direction of the contractible hose toward each other, a self-limiting effect may occur when contraction forces exist, such effect causing the contractible hose, which is subject to a pulling force, is braced between the retaining cuff and the force applying part in addition.

In order to strengthen the force transmitting join between the contractible hose and the force applying part these two components may be additionally sewn together. If the contractible hose extends past the retaining cuff at its free end and at this free end is secured by sewing to the force applying part, splaying outward of this seam may be restricted owing to the positive engagement and accordingly it may be secured. Furthermore, the thermal load on the stitches is minimized.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

FIG. 1 diagrammatically illustrates in longitudinal section a one embodiment of the gas operated contraction drive of the invention, the deactivated initial state being depicted in full lines and the activated operating state being illustrated in chained lines.

DETAILED ACCOUNT OF WORKING EMBODIMENTS OF THE INVENTION

Figure 1:
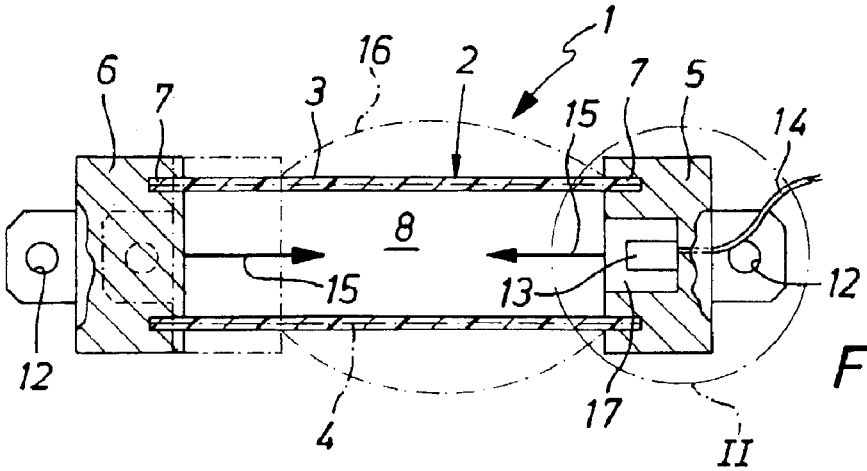

A gas operated contraction drive generally referenced 1 is illustrated in the drawing, which is suitable for any desired application, in the case of which at least two bodies or structures are to be moved in relation to one another.

The contraction drive 1 has a structure with a linear extent and configured in a hose-like form, which is termed a contractible hose 2. In the working embodiment illustrated the contractible hose 2 comprises a hose body 3 consisting of a rubber-like material and a tensile fiber arrangement 4 which is coaxial to the hose body 3 and is preferably at least partially embedded in the wall of the hose body 3. The arrangement 4 is only diagrammatically indicated in the drawings.

The contractible hose 2 extends between two force applying units 5 and 6, which may be termed head pieces. The two end sections 7 of the contractible hose are attached to the respectively associated force applying unit 5 and 6 for the transmission of draw forces.

A working space 8 is jointly delimited by the contractible hose 2 and the two terminal force applying units 5 and 6. This space is hermetically sealed off from the outside.

Force applying means 12 are arranged on each force applying unit 5 and 6. Using them the force applying units 5 and 6 may be attached to the components or structures which are to be moved in relation to each other and which in the drawing are not illustrated in detail. In the working embodiment illustrated the force applying means 12 are in the form of attachment holes in an attachment eye, which for example is lug-like, belonging to the respective force applying unit 5 and 6. It will be clear that the force applying means 12 may have any suitable desired configuration.

The contraction drive 1 is provided with a pyrotechnic gas generator 13. Several such gas generators could be provided but the present account however is based on only one gas generator 13.

The pyrotechnic gas generator 13 is arranged in the interior of the working space 8. It is a question of a design which is electrically ignited or fired, an electrical cable 14 being indicated in the drawing extending from the gas generator 13 and out of the working space 8 and serving for the supply of electrical ignite signals as necessary for activation.

In the deactivated initial state of the contraction drive 1 the contractible hose 2 assumes the elongated form as in FIG. 1 with a constant cross section along its entire length. The force applying means 12 of the two force applying units 5 and 6 are in this case at the maximum distance apart.

For activation of the contraction drive 1 the gas generator 13 is fired. Accordingly within a few milliseconds a large volume of gas is released owing to combustion of the propellant powder charge, such gas being termed the drive gas in view of its purpose.

The drive gas produced causes the working space 8 to be subjected to a heavy pressure resulting from the gas pressure produced. As a consequence the contractible hose 2 expands radially and simultaneously contracts in the length direction so that the two force applying units 5 and 6 attached to it are pulled together by it in the contraction direction indicated by the arrows in the direction 15. The activated actuating condition which may be so produced in this manner is indicated in FIG. 1 at 16 by chained lines.

The longitudinal contraction is substantially on the basis of the tensile fiber arrangement 4, which in the working example comprises a plurality of fibers which have a high tensile strength while being flexible at the same time, such fibers being crossed over so that, as considered in a radial direction, a sort of lattice structure results. When the contractible hose body 3 is subjected to an internal pressure the lattice angle is altered and accordingly also the inclination between the individual tensile fibers, something which ultimately produces the desired longitudinal contraction. The actual design may for example be the same as that employed in the initially mentioned patent publications.

Since during the longitudinal contraction the force applying means 12 are moved toward each other the externally secured components and structures are subjected to a force, which causes a relative movement.

Seeing that the drive gas is produced directly where it is utilized, it is immediately available for activation of the contraction drive 1 so that the contraction drive 1 has an extremely short response time and is able to apply heavy forces in a minimum time.

Preferably the gas generator 13 is secured to one of the force applying units 5. Should a plurality of gas generators be present, one or more gas generators may be secured to both force applying units 5 and 6.

It is convenient to accommodate the gas generator 13 in a receiving recess 17 in the respective force applying unit 5, such receiving recess 17 being open toward the space delimited by the contractible hose. This means that the gas generator 13 and with it the zone of gas development may be kept clear of the direct neighborhood of the contractible hose 2. Given a suitable depth and/shape of the receiving recess 17 its wall may perform a shielding function during the explosion so that the material of the contractible hose 2 is screened off from the zone with the highest temperatures and heaviest pressure surge.

Preferably the receiving recess 17 is placed as an axial and more especially coaxial extension of the internal space in the contractible hose 2 and together with same constitutes the above mentioned working space 8.

The contraction drive 1 may be very simple in structure. Since the drive gas is generated directly in the contraction drive 1 itself, fluid ducts for the supply of the drive gas into the working space 8 are unnecessary. Such a contraction drive 1 is more especially predestined for once-only use, for example in conjunction with triggering certain safety mechanisms.

In the following a form of the contraction drive 1 will be described on the basis of FIGS. 2 and 3 which is considered to be particularly appropriate, the explanations so far also applying for this further design so that functionally equivalent components are provided with identical reference numerals.

Figure 2:
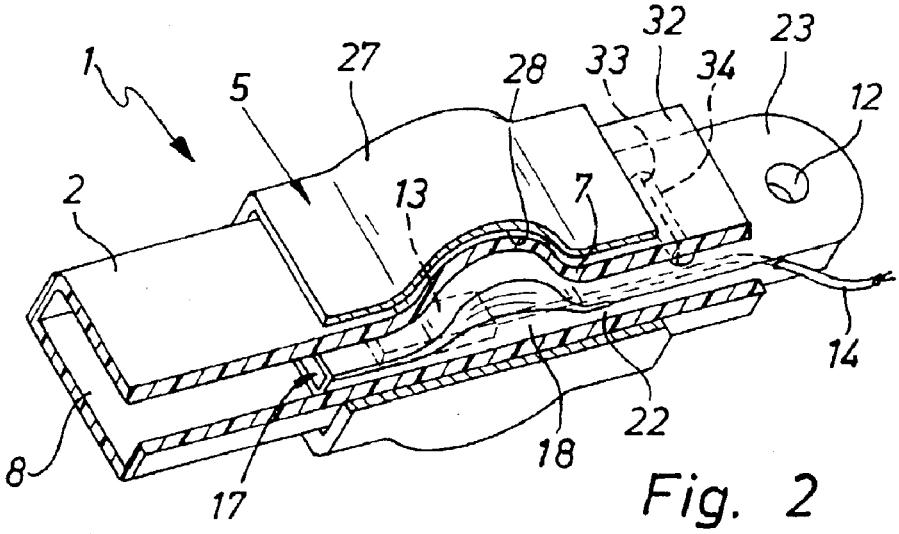
FIG. 2 shows the terminal section of a preferred design of the contractible hose in accordance with the portion II indicated in FIG. 1, a particularly advantageous form of a force applying unit being represented partly cut away.
Figure 3:
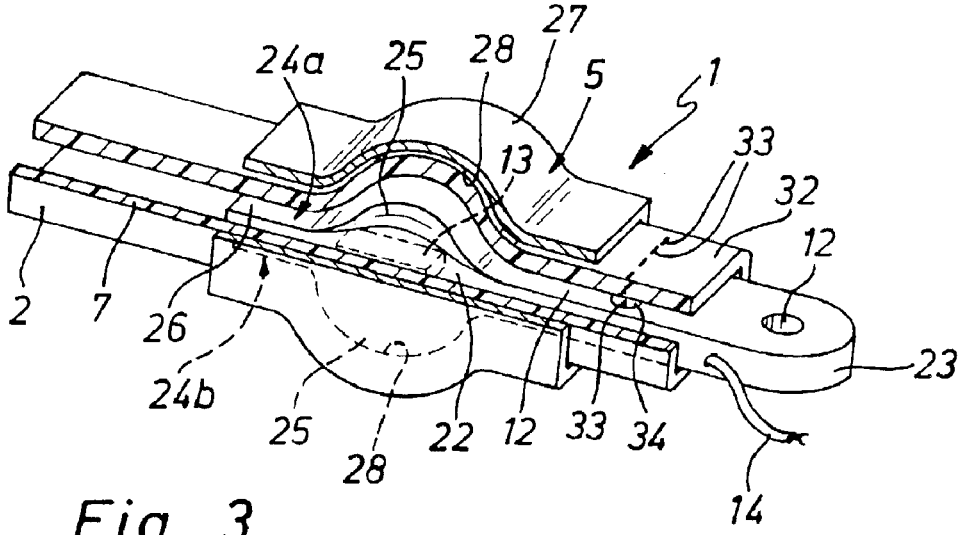
FIG. 3 shows the arrangement of FIG. 2, again partly cut away, from a different angle of view.

FIGS. 2 and 3 show detail the one end section of a contraction drive 1, a force applying unit 5 with an integral gas generator 13 being shown. The force applying unit 6 provided at the opposite end and not depicted in detail, may be the same in design—with or without a gas generator 13—or in case of need it may also be different in design.

The illustrated, preferred force applying unit 5 possesses a force applying part 18 having the force applying means 12, such part 18 having a plate-like anchoring section 22 plunging into the contractible hose 2 and only extending out from the contractible hose 12 in the form of the force applying section 23 with the force applying means 12. At the two opposite flat plate sides of the anchoring section 22 a respective hump-like raised portion 25 is provided, the two raised portions 25 being axially at the same level in relation to contraction direction 15.

Preferably, the force applying part 18 has a rectangular cross section axially within and axially clear of the hump-like raised portions 25.

The end section of the contractible hose 2 seated on the anchoring section 22 of the force applying part 18 makes snug contact on and around the anchoring section 22. This is enhanced by the rubber-like elasticity of the contractible hose body 3.

An inner end section 26 (which is axial in relation to the contractible hose 2) of the anchoring section 22 adjoins the hump-like raised portions 25 and is utilized in the working example in order to force the deactivated contractible hose 2 into a space saving flat shape. This is most clearly illustrated in FIGS. 2 and 3.

At the hump-like raised portions 25 a retaining cuff 27 is placed on the outer periphery of the contractible hose 2 which it surrounds. This cuff is a molding which is made concave at its inner periphery to correspond to the hump-like raised portions 25. The concavities are indicated at 28.

It is in this manner that the contractible hose 2 has its end section sandwiched and held fast over a large area between the anchoring section 22 placed in its interior and the retaining cuff 27 surrounding it.

It is an advantage for the hump-like raised portions 25 to be rounded off so that they are free of sharp edges likely to cut into the contractible hose 3. In the working embodiment they are respectively semi-cylindrical in shape in each case, the transitional zone between the peripheral face and the end faces being rounded off to be convex, whereas at the transition merging with the axially adjoining the flat plate sections are rounded to be concave.

The hump-like raised portions 25 may together constitute a spherical body in order to be able to apply an even retaining force over the full periphery of the contractible hose 2.

It is convenient for the retaining cuff 27 to be connected with the force applying part 18 in a manner which is not firm or rigid. As a result in the contraction direction 15 of the contractible hose 2 there is a limited relative mobility between the retaining cuff 27 and the force applying part 18, the limit of movement being due to the interlocking raised portions 25 and concavities 28. If the contractible hose 2 is subject to a tensile load by the drive gas produced, it will pull the retaining cuff 27 some distance with it so that the end section of the gas generator 2 is actively clamped between the retaining cuff 27 and the outer face of the anchoring section 22. The greater the holding force, the greater the tensile force acting on the contractible hose 2. Accordingly there is a secure connection able to withstand tensile loading.

In case of need an additional attachment of the contractible hose 2 to the force applying part 18 is possible. Such attachment is produced in the working example because the contractible hose 2 is stitched to the force applying part 18 clear of the portion subjected to internal pressure during operation.

In accordance with FIGS. 2 and 3 there is the preferred design such that the contractible hose 2 clamped in place has its free end extending out toward the force applying means 12 past the retaining cuff 27 and such free end 32 is stitched or sewn to the force applying part 18. The thread employed for sewing is indicated at 33. Preferably sewing is performed in such a manner that wall sections of the contractible hose 2 on opposite sides of the force applying part 18 are sewn together through one or more openings 34 in the force applying part 18.

In addition it is also to be noted that for ignition the necessary signals may also be supplied to the gas generator 13 in a wireless manner, more particularly by radio. There is furthermore the possibility of accommodating energy storage means in the contraction drive 1 and more particularly in or on a force applying unit, such storage means making available the electrical energy required for triggering the gas generator 13 for use at any time. Such an energy storage means may also be a direct component of the gas generator 13. The gas generator 13 is furthermore preferably installed as a cartridge-like unit in the contraction drive 1.

What is claimed is:

1. A gas operated contraction drive comprising a contractible hose which under the action of pressure of a drive gas in a working space, delimited by the hose, is longitudinally contracted, wherein the contraction drive is provided with at least one pyrotechnic gas generator for the production of the drive gas, wherein the contractible hose possesses a contractible hose body including rubber-elastic material and a tensile fiber arrangement arranged coaxially to the contractible hose and embedded within a wall of the rubber-elastic hose body, and wherein the contractible hose has two end portions which respectively have a force applying unit attached thereto, said force applying units rendering possible transmission of the drive force which is produced.

2. The contraction drive as set forth in claim 1, wherein the pyrotechnic gas generator is designed for electrical operation thereof.

3. The contraction drive as set forth in claim 1, wherein the pyrotechnic gas generator is arranged in the interior of the working space.

4. The contraction drive as set forth in claim 1, wherein the tensile fiber arrangement comprises tensile fibers arranged crossing over one another.

5. The contraction drive as set forth in claim 1, wherein the working space is hermetically sealed off from the outside.

6. The contraction drive as set forth in claim 1, wherein the gas generator is secured to a force applying unit.

7. The contraction drive as set forth in claim 1, wherein at least one force applying unit comprises a receiving recess open toward the inner space of the contractible hose, a gas generator being arranged in such recess.

8. A gas operated contraction drive comprising a contractible hose which under the action of pressure of a drive gas in a working space, delimited by the hose, is longitudinally contracted, wherein the contraction drive is provided with at least one pyrotechnic gas generator for the production of the drive gas, wherein the two end portions of the contractible hose respectively have a force applying unit attached to them, said unit rendering possible transmission of the drive force which is produced, and wherein at least one force applying unit comprises a force applying part possessing force applying means, such force applying part having a plate-like anchoring section plunging into the contractible hose, a respective hump-like raised portion being provided at the two flat plate sides, against which raised portion the slipped on contractible hose may rest snugly, a retaining cuff behind placed adjacent to the hump-like raised portions, said cuff surrounding the contractible hose and having internal concavities corresponding to the hump-like raised portions.

9. The contraction drive as set forth in claim 8, wherein the force applying part and the retaining cuff are able to be moved in the contraction direction of the contractible hose in relation to one another to a limited extent.

10. The contraction drive as set forth in claim 8, wherein the two hump-like raised portions are at the same axial level and preferably jointly constitute a spherical body.

11. The contraction drive as set forth in claim 8, wherein the contractible hose is stitched to the force applying part.

12. The contraction drive as set forth in claim 8, wherein the contractible hose has its free end extending past the retaining cuff, it being secured at such free end to the force applying part by stitching.

13. The contraction drive as set forth in claim 8, wherein as a force applying means at least one attachment hole or the like is provided at the end section extending out from the contractible hose.

14. The contraction drive as set forth in claim 8, wherein the force applying part has in its anchoring section a receiving recess, which is open toward the internal space of the contractible hose at least one pyrotechnic gas generator being located in the recess.

* * * * *